US006637399B2

(12) United States Patent
Sato et al.

(10) Patent No.: US 6,637,399 B2
(45) Date of Patent: Oct. 28, 2003

(54) LUBRICATION STRUCTURE IN OHC ENGINE

(75) Inventors: Yoshikazu Sato, Saitama (JP); Shinji Katayama, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/073,263

(22) Filed: Feb. 13, 2002

(65) Prior Publication Data

US 2002/0121260 A1 Sep. 5, 2002

(30) Foreign Application Priority Data

Feb. 14, 2001 (JP) ..... 2001-036556

(51) Int. Cl.[7] ..... F01M 9/06; F01M 9/10
(52) U.S. Cl. ..... 123/196 R; 123/196 M
(58) Field of Search ..... 123/196 R, 196 M, 123/196 S, 193.5

(56) References Cited

U.S. PATENT DOCUMENTS

| | | | | |
|---|---|---|---|---|
| 4,122,818 A | * | 10/1978 | Hattori | 123/196 AB |
| 5,857,441 A | * | 1/1999 | Yonezawa et al. | 123/196 R |
| 5,887,678 A | * | 3/1999 | Lavender | 123/196 R |
| 6,000,373 A | * | 12/1999 | Woodhouse | 123/196 R |
| 6,138,633 A | * | 10/2000 | Prior | 123/196 R |

FOREIGN PATENT DOCUMENTS

| | | |
|---|---|---|
| JP | 8-177441 | 7/1996 |
| JP | 9-151720 | 6/1997 |

* cited by examiner

*Primary Examiner*—Henry C. Yuen
*Assistant Examiner*—Jason Benton
(74) *Attorney, Agent, or Firm*—Arent Fox Kintner Plotkin & Kahn, PLLC

(57) ABSTRACT

An OHC engine includes a valve operation system housed in a valve operation chamber formed between a cylinder head and a head cover joined to the cylinder head. The valve operation system includes a valve-operating cam and is cooperatively connected to an intake valve and an exhaust valve. The OHC engine also includes timing transmitting device disposed between the valve operation system and a crankshaft, the timing transmitting means including a driven wheel that rotates together with the valve-operating cam and a transmission belt that is wrapped around the driven wheel so that oil within a crankcase can accompany the transmission belt and be supplied to the valve operation chamber. The head cover is provided with an arc-form curved cover part for covering the upper part of the driven wheel. The curved cover part integrally includes above the driven wheel a plurality of oil splashing ribs that are positioned at intervals along the rotational direction of the driven wheel to project toward the side that is closer to the transmission belt, thereby allowing oil to be supplied uniformly to each section of the valve operation system.

2 Claims, 14 Drawing Sheets

LUBRICATION STRUCTURE IN OHC ENGINE

BACKGROUND OF THE INVENTION

1. Field of the Invention

The present invention relates to an OHC engine in which a valve operation system is housed in a valve operation chamber formed between a cylinder head and a head cover joined to the cylinder head. The valve operation system includes a valve-operating cam that is rotatably supported by the cylinder head and is cooperatively connected to an intake valve and an exhaust valve; and timing transmitting means disposed between the valve operation system and a crankshaft. The timing transmitting means includes a driven wheel that rotates together with the valve-operating cam and a transmission belt that is wrapped around the driven wheel, so that oil within a crankcase is carried by the transmission belt and is supplied to the valve operation chamber. In particular, it relates to an improvement of a lubrication structure for the valve operation system.

2. Description of the Prior Art

A conventional lubrication structure for an OHC engine is already known in, for example, Japanese Patent Application Laid-open No. 8-177441, wherein oil is supplied to a valve operation system by means of the oil being carried by a timing belt that is for transmitting the rotational power of a crankshaft to the valve operation system.

In order to lubricate a valve operation system with the oil supplied to a valve operation chamber by means of a timing belt, etc., it is necessary to splash the oil within the valve operation chamber. In the above-mentioned conventional arrangement, the oil is splashed by means of inertial force and centrifugal force imposed on the oil in the section where the timing belt is wrapped around a driven pulley, but in order to satisfy the lubrication requirements that become more strict as the load and rotational speed of an engine increase, it is necessary to splash the oil more finely.

In a lubrication structure disclosed in Japanese Patent Application Laid-open No. 9-151720, a wall is provided on a head cover, in a section where a timing belt is wrapped around a driven pulley, at a position on a line that extends over the slack side of the timing belt, the oil that has separated from the timing belt due to inertial force collides with the wall, and the oil is thereby atomized so as to fill a valve operation chamber.

Even in accordance with the lubrication structure of Japanese Patent Application Laid-open No. 9-151720, it is difficult to splash the oil uniformly within the valve operation chamber, and there is a possibility that, among the members forming the valve operation system, oil supply to the member that is positioned on the tensioned side of the timing belt might become insufficient.

SUMMARY OF THE INVENTION

The present invention has been carried out in view of the above-mentioned circumstances, and it is an object of the present invention to provide a lubrication structure in an OHC engine that can supply oil uniformly to each section of a valve operation system.

In order to accomplish this object, in accordance with a first aspect of the present invention, there is proposed a lubrication structure in an OHC engine. The lubrication structure includes a valve operation system housed in a valve operation chamber formed between a cylinder head and a head cover joined to the cylinder head, the valve operation system including a valve-operating cam that is rotatably supported by the cylinder head and is cooperatively connected to an intake valve and an exhaust valve. The lubrication structure also includes timing transmitting means disposed between the valve operation system and a crankshaft, the timing transmitting means including a driven wheel that rotates together with the valve-operating cam and a transmission belt that is wrapped around the driven wheel, so that oil within a crankcase can be carried by the transmission belt and be supplied to the valve operation chamber. The head cover is provided with an arc-form curved cover part for covering the upper part of the driven wheel, and the curved cover part above the driven wheel is provided integrally with a plurality of oil splashing ribs that are placed at intervals along the rotational direction of the driven wheel to project toward the side that is closer to the transmission belt.

In accordance with the above-mentioned arrangement, the oil that has been conveyed to the valve operation chamber while attached to the transmission belt is made to separate from the transmission belt due to centrifugal force in the section where the transmission belt is wrapped around the driven wheel, and the oil so detached collides with the oil splashing ribs and is atomized. Since the oil splashing ribs are provided on the curved cover part of the head cover at a plurality of positions at intervals along the rotational direction of the driven wheel, when the transmission belt runs in the section where it is wrapped around the driven wheel, the oil that has passed by one oil splashing rib collides with a following oil splashing rib and is splashed, thereby reliably splashing the oil at a plurality of positions and ensuring that the oil can reliably reach each part of the valve operation system. Moreover, the plurality of oil splashing ribs also have the function of reinforcing the head cover.

Furthermore, in accordance with a second aspect of the present invention, there is proposed a lubrication system in an OHC engine, wherein the valve operation system further includes intake side and exhaust side rocker arms cooperatively connected to the corresponding intake valve and exhaust valve and individually in sliding contact with the lower part of the valve-operating cam at positions on opposite sides of, and an equal distance from, a vertical line passing through the rotational axis of the valve-operating cam coaxially and integrally formed with the driven wheel. A pair of the oil splashing ribs are placed outside a pair of vertical lines, in a projection on a vertical plane that is orthogonal to the rotational axis of the valve-operating cam, that pass through the parts of the rocker arms that are in sliding contact with the valve-operating cam. In accordance with the arrangement, the oil that has collided with the pair of oil splashing ribs can reliably reach the sections where the intake side and exhaust side rocker arms slide on the valve-operating cam. Reliable lubrication of the valve operation system can thereby be carried out by means of a small number of oil splashing ribs.

Furthermore, in accordance with a third aspect of the present invention, there is proposed an OHC engine wherein each of the oil splashing ribs is provided integrally with the curved cover part extending in a direction orthogonal to the rotational direction of the driven wheel. In accordance with the above-mentioned arrangement, the oil can collide with the oil splashing ribs at right angles, and the oil can thereby be splashed more finely.

BRIEF DESCRIPTION OF THE DRAWINGS

FIG. 1 is a side view of a portable engine generator.

FIG. 2 is a view from line 2—2 in FIG. 1.

FIG. 3 is a cross section at line 3—3 in FIG. 2.

FIG. 4 is a cross section at line 4—4 in FIG. 2.

FIG. 5 is a cross section at line 5—5 in FIG. 4.

FIG. 6 is a longitudinal cross section viewed from the same direction as in FIG. 3.

FIG. 7 is a cross section at line 7—7 in FIG. 6.

FIG. 8 is a magnified cross section at line 8—8 in FIG. 6.

FIG. 9 is a magnified view of an essential part in FIG. 6.

FIG. 10 is a magnified view from arrow 10 in FIG. 6.

FIG. 11 is a cross section at line 11—11 in FIG. 6.

FIG. 12 is a magnified cross section at line 12—12 in FIG. 7.

FIG. 13 is a magnified cross section at line 13—13 in FIG. 7.

FIG. 14 is a cross section corresponding to FIG. 11 while changing the attitude of the engine when in a laid-sideways state in 90° steps.

DESCRIPTION OF PREFERRED EMBODIMENTS

Figure 1:
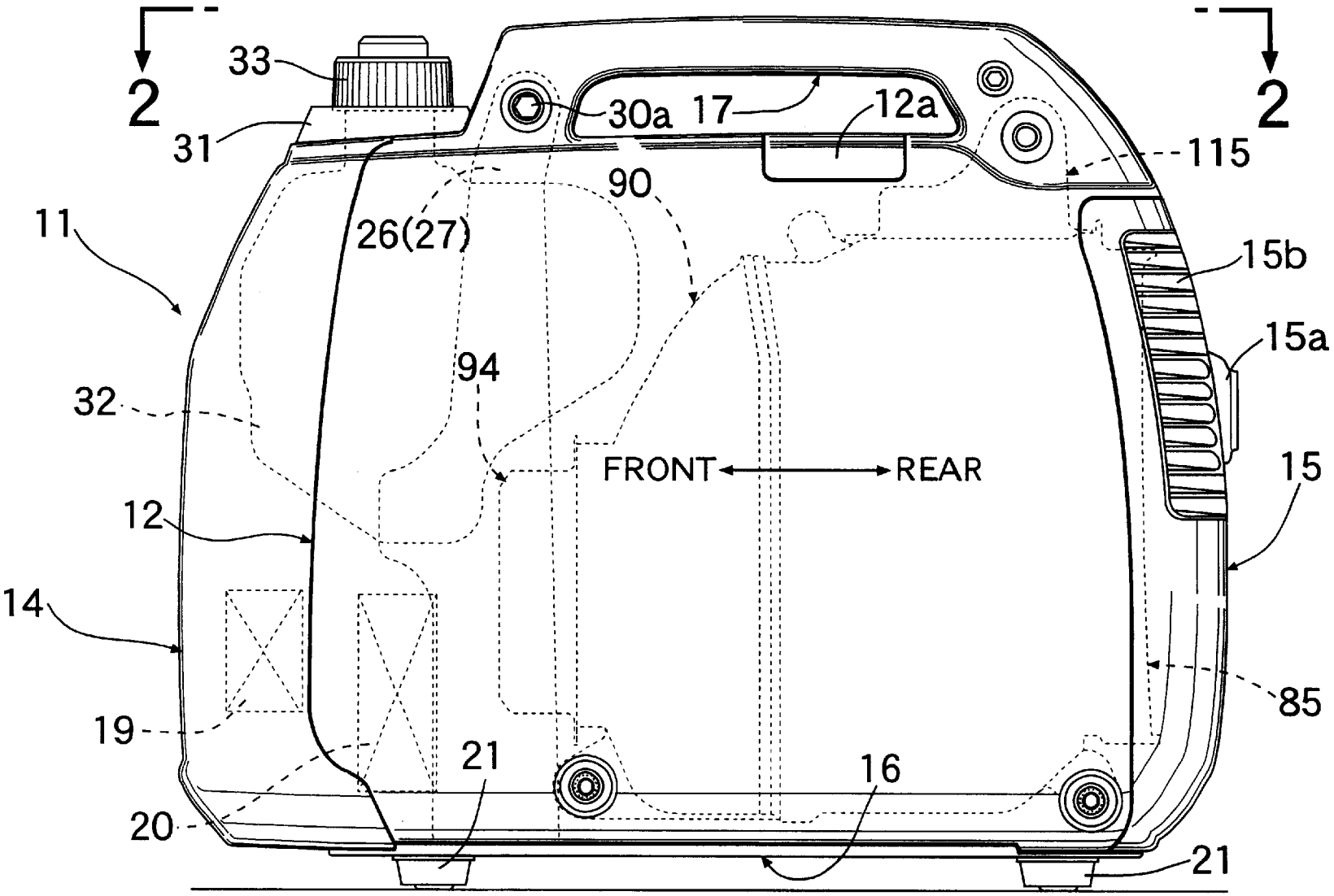
FIGS. 1 to 14 illustrate one embodiment of the present invention.
Figure 2:
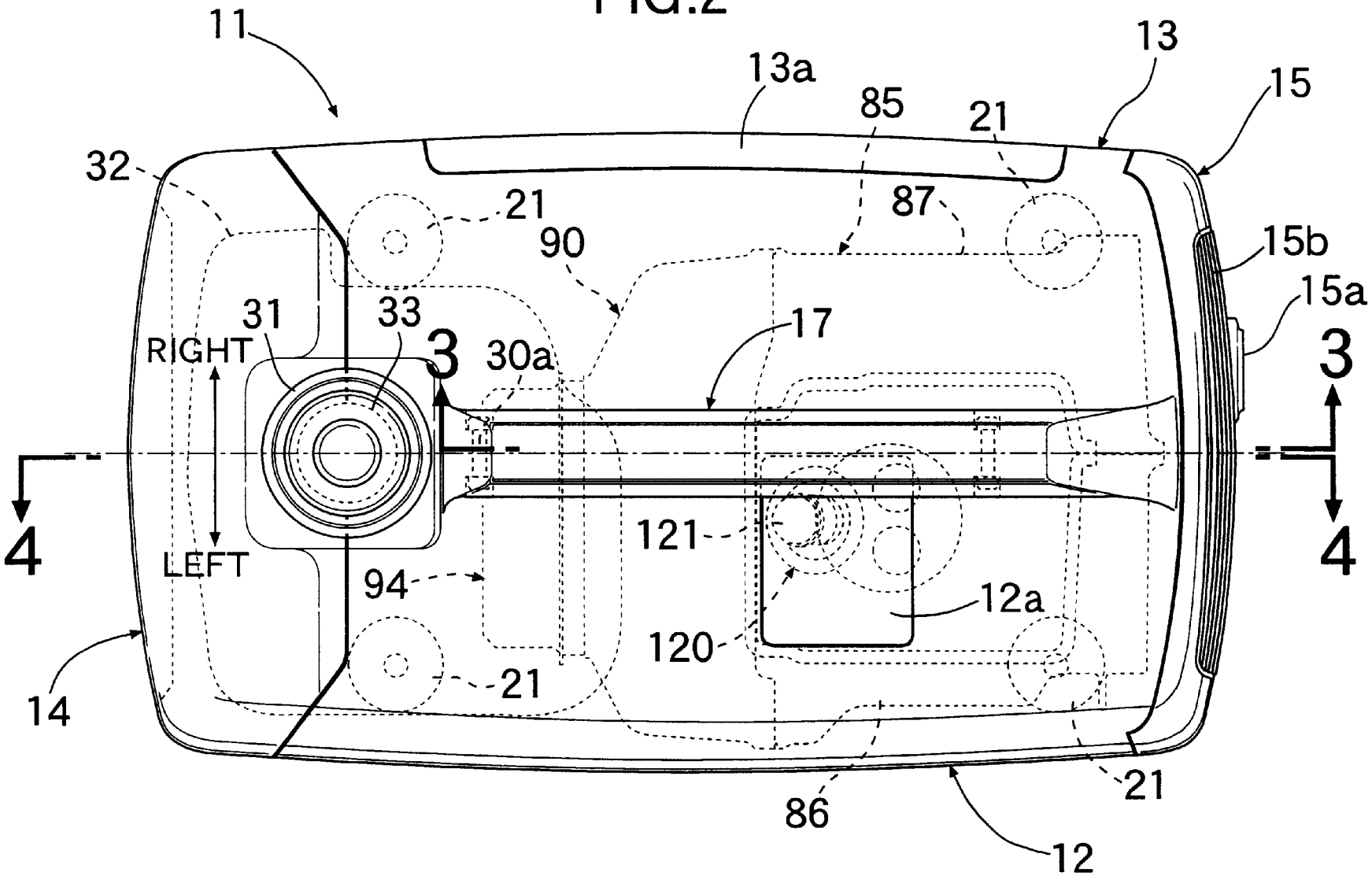
Figure 3:
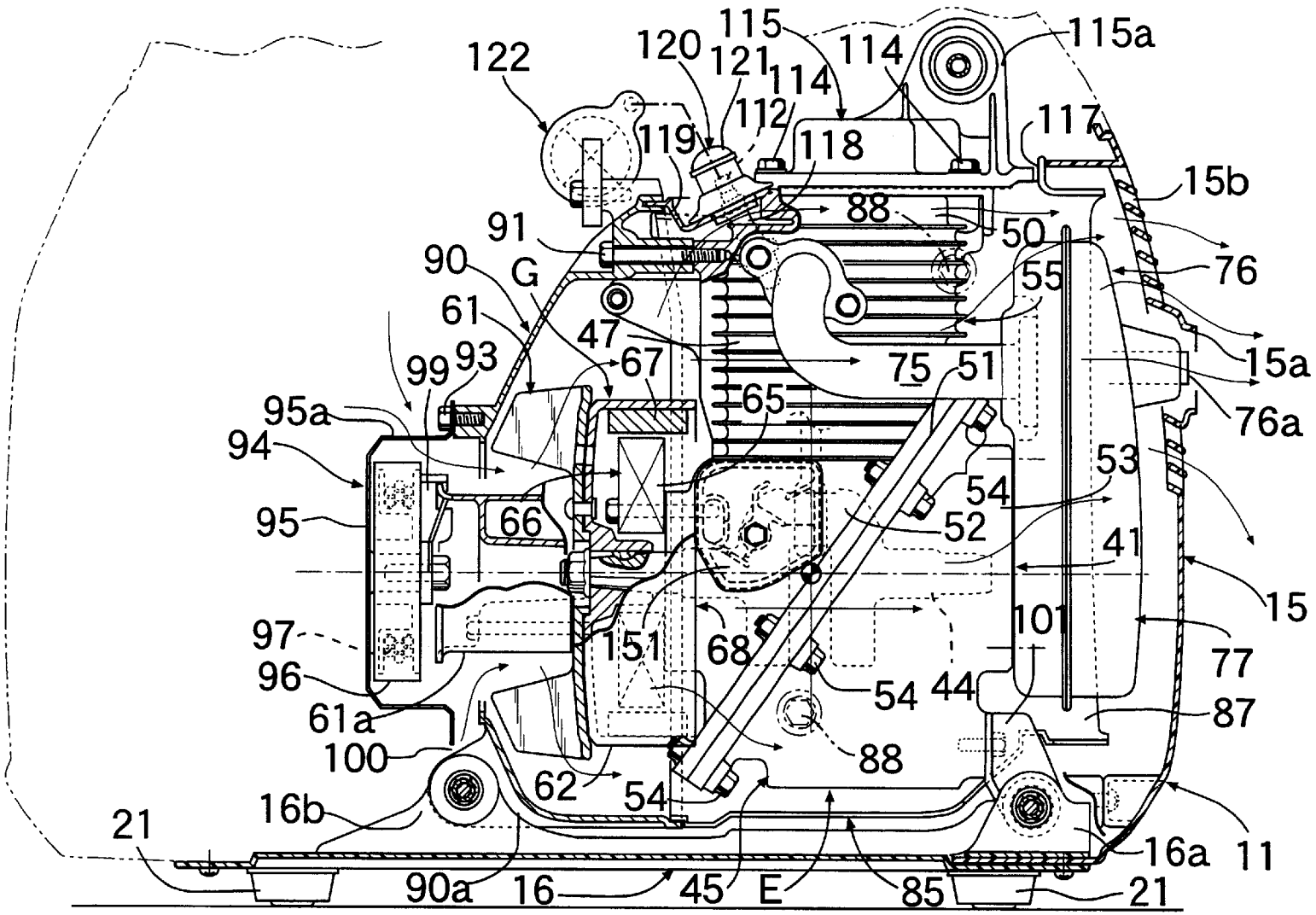
Figure 4:
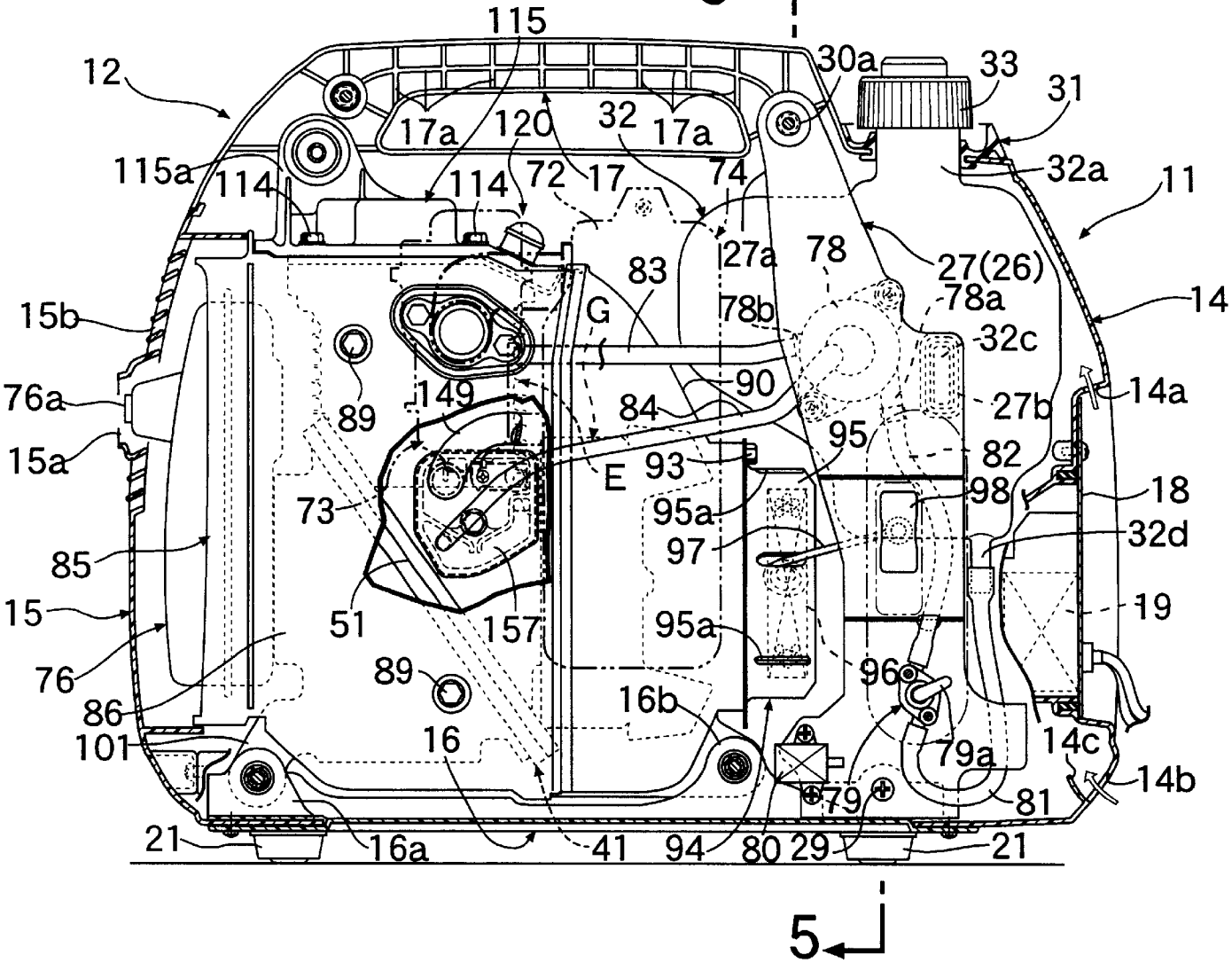

One embodiment of the present invention is explained below by reference to FIGS. 1 to 14. Referring to FIGS. 1 to 4, a synthetic resin case 11 forms an outer shell of a portable engine generator, which is a portable engine-operated machine. The case 11 is formed from a left side cover 12, a right side cover 13, a front cover 14, a rear cover 15 and a under cover 16, which are joined to each other. Provided on the upper parts of the left and right side covers 12 and 13 is a carrying handle 17 for carrying the engine generator. Radial reinforcing ribs 17*a* are formed within the carrying handle 17 as shown in FIG. 4.

The left side cover 12 is provided with a lid 12*a,* which can be opened and closed, for replacing a spark plug. The right side cover 13 is provided with a lid 13*a,* which can be opened and closed, for maintenance. The front cover 14 is provided with a control panel 18. Provided on the inside face of the control panel 18 is a control unit 19 for controlling the operation of an engine E and a generator G that is driven by the engine E. Provided behind the control unit 19 is an inverter unit 20 for controlling the output frequency of the generator G. The front cover 14 is provided with a cooling air inlet 14*a* positioned above the control panel 18 and a cooling air inlet 14*b* positioned beneath the control panel 18 and further with a guide part 14*c* connected to the cooling air inlet 14*b*. The rear cover 15 is provided with an exhaust gas outlet 15*a* for discharging the exhaust gas from the engine E and a cooling air outlet 15*b* for discharging the cooling air from the case 11. The under cover 16 is provided with four rubber support legs 21 that make contact with the ground or a floor when the engine generator is placed thereon.

Figure 5:
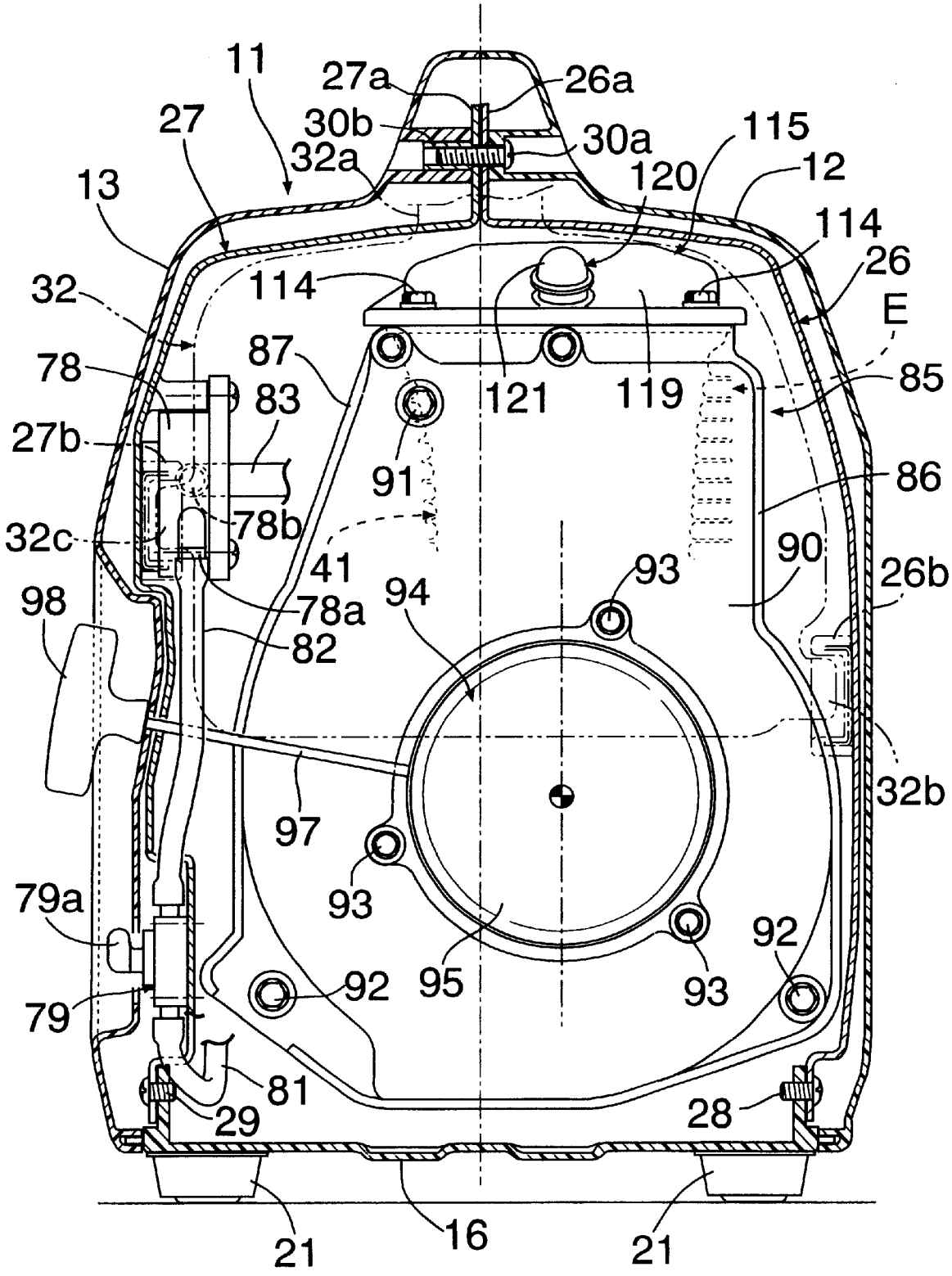

Referring also to FIG. 5, left and right reinforcing frames 26 and 27 made of FRP are disposed within a front part of the case 11. The left reinforcing frame 26 is formed in an inverted L-shape, rising upward along the inner face of the left side cover 12 and extending inward in the lateral direction in the upper part. The lower end of the left reinforcing frame 26 is secured to the under cover 16 by means of a bolt 28. The right reinforcing frame 27 is also formed in an inverted L-shape, rising upward along the inner face of the right side cover 13 and extending inward in the lateral direction in the upper part. The lower end of the right reinforcing frame 27 is secured to the under cover 16 by means of a bolt 29. Integrally provided on the upper ends of the left and right reinforcing frames 26 and 27 are mounting parts 26*a* and 27*a* that are bent upward to contact each other. The left and right reinforcing frames 26 and 27 together form an arch shape, in which the mounting parts 26*a* and 27*a* make contact with each other. The mounting parts 26*a* and 27*a* are clamped between the left and right side covers 12 and 13 in the front part of the carrying handle 17 and fastened by means of a bolt 30*a* and a nut 30*b* together with the left and right side covers 12 and 13.

A rubber seal 31 is attached to a part where the left and right side covers 12 and 13 and the upper part of the front cover 14 are joined together. A fuel tank 32 is arranged above the inverter unit 20 on one side at the front of the engine E. The fuel tank 32 has a refueling inlet 32*a* on its top, and the refueling inlet 32*a* runs through the seal 31, projects above the case 11 and is blocked with a detachable cap 33.

Projectingly provided on the left and right side faces of the fuel tank 32 are projections 32*b* and 32*c,* which are in a loose fit with fuel tank supports 26*b* and 27*b* of the left and right reinforcing frames 26 and 27, thereby positioning and supporting the fuel tank 32 in the left and right reinforcing frames 26 and 27 in a non-vibrating manner.

Figure 6:
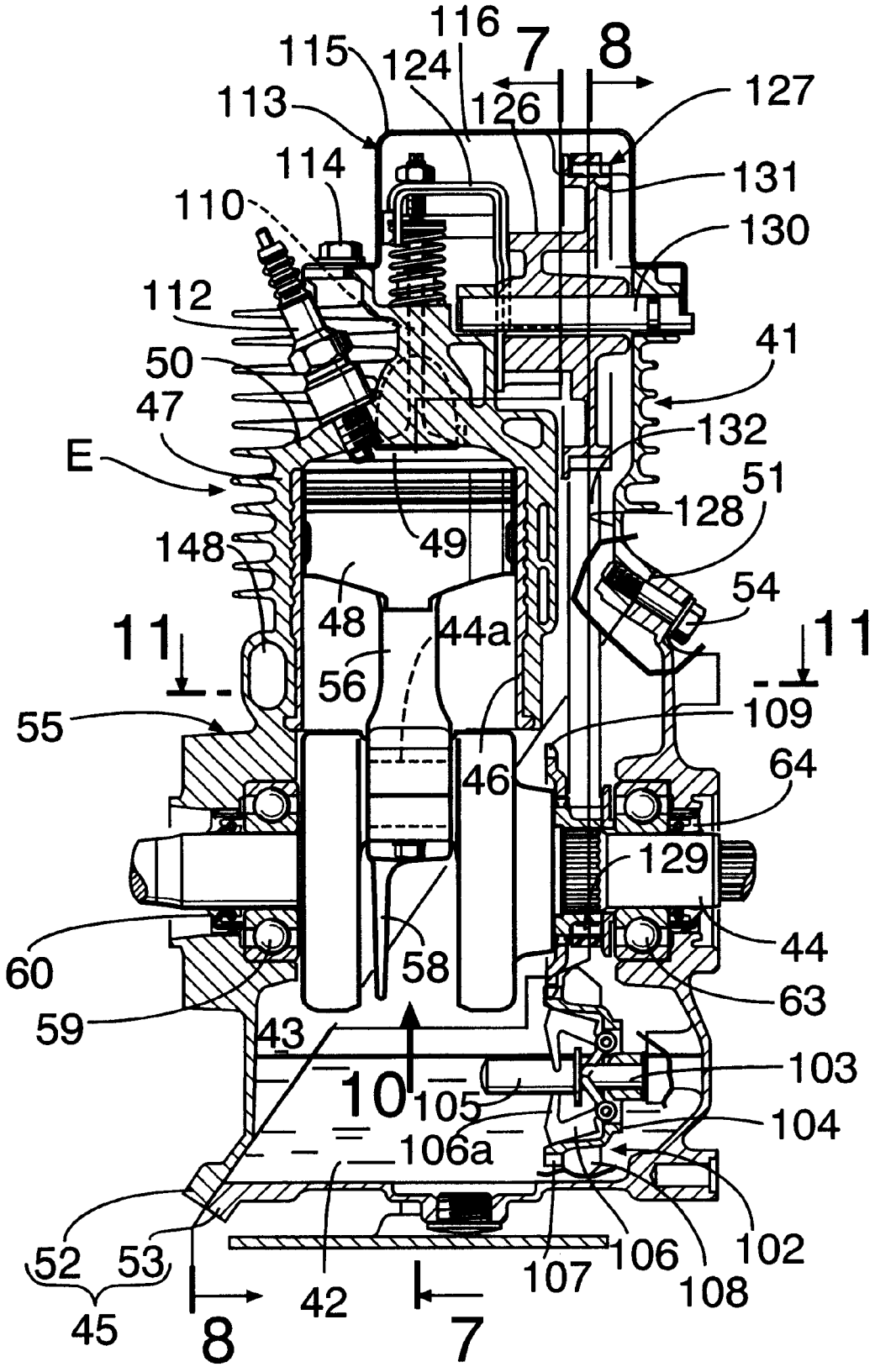
Figure 7:
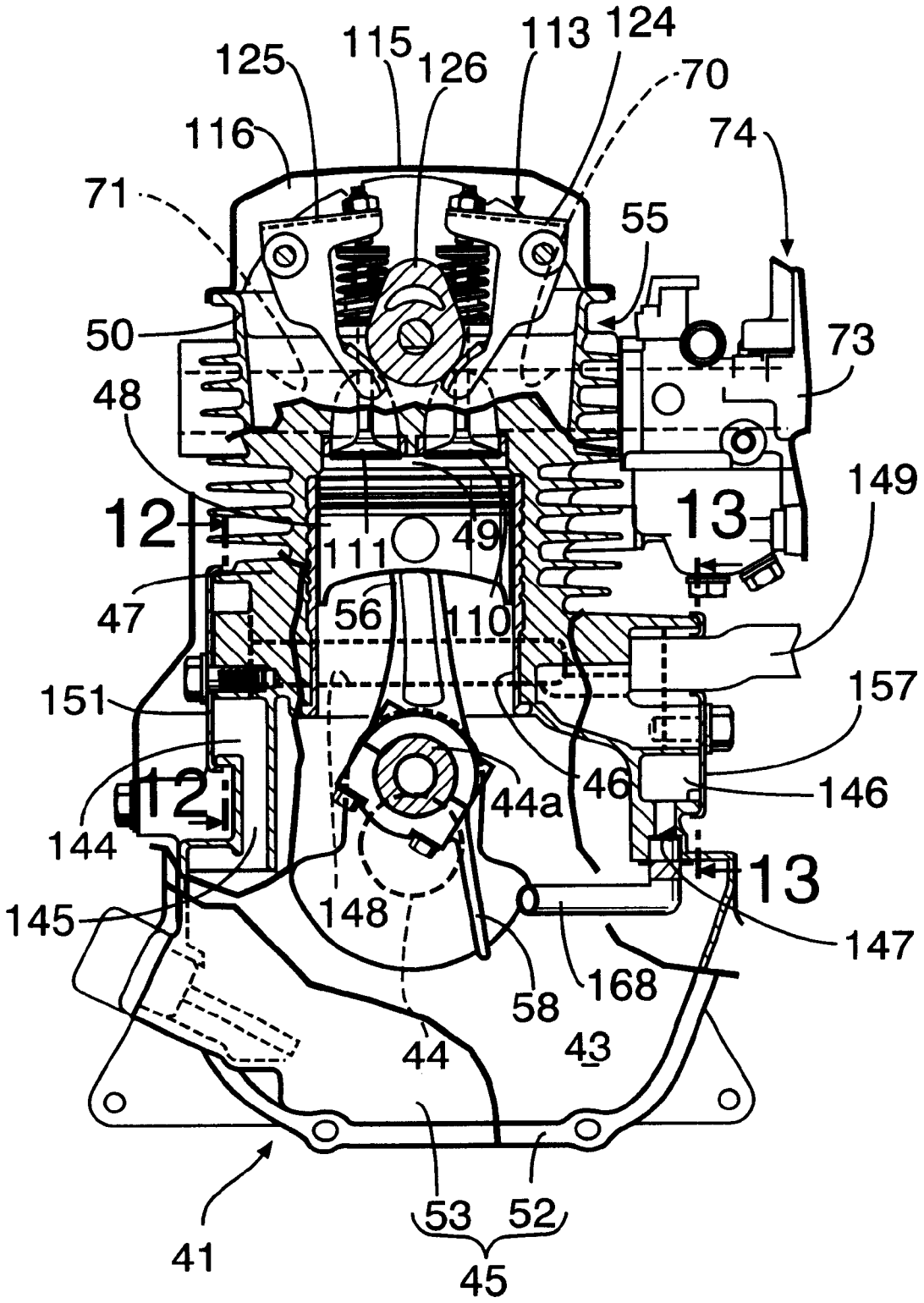

Referring also to FIGS. 6 and 7, an engine main body 41 of the engine E, which is a four-cycle, single-cylinder, OHC engine, includes a crankcase 45, a cylinder barrel 47, and a cylinder head 50. The crankcase 45 forms a crank chamber 43 for storing oil 42 and supports a crankshaft 44 whose axis is substantially horizontal when the generator G is in use. The cylinder barrel 47 has a cylinder bore 46 which has an axis which is substantially vertical when the generator G is in use. Formed between the cylinder head 50 and the top of a piston 48 is a combustion chamber 49, the piston 48 being slidably fitted in the cylinder bore 46.

The crankcase 45 is formed by connecting first and second case halves 52 and 53 to each other by means of a plurality of bolts 54, the case halves 52 and 53 being separable from each other along a separation plane 51 that intersects the axis of the crankshaft 44 obliquely. The first case half 52, the cylinder barrel 47 and the cylinder head 50 are made as one piece by casting, thereby forming an engine block 55.

The piston 48 is connected to a crankpin 44*a* of the crankshaft 44 via a connecting rod 56. Formed integrally on the larger end of the connecting rod 56 is an oil dipper 58 for splashing the oil 42 within the crank chamber 43.

One end of the crankshaft 44 projects out of the crankcase 45 with a ball bearing 59 and an annular seal 60 disposed between the first case half 52 and the one end of the crankshaft 44. Fixed to the one end of the crankshaft 44 outside the crankcase 45 is a flywheel 62 integrally having a cooling fan 61.

The other end of the crankshaft 44 is supported in the second case half 53 via a ball bearing 63 with an annular seal 64 disposed between the other end of the crankshaft 44 and the second case half 53.

The generator G is of an outer rotor type and is provided in cantilever form on the one end of the crankshaft 44 projecting forward, out of the crankcase 45. The generator G includes a stator 66 and a rotor 68. The stator 66 has a coil 65 and is fixed to the front face of the crankcase 45. The rotor 68 is formed from the flywheel 62 and a plurality of permanent magnets 67 fixed to the inner face of the flywheel 62.

Provided in the cylinder head 50 are an intake port 70 and an exhaust port 71, which can communicate with the combustion chamber 49. An intake system 74 including an air cleaner 72 and a carburetor 73, is supported on the cylinder head 50 to communicate with the intake port 70. The intake system 74 is placed on the right side of the cylinder head 50. Placed on the left side of the cylinder head 50 is an exhaust system 77 including an exhaust pipe 75 and an exhaust muffler 76. The exhaust pipe 75 is connected to the exhaust port 71 and the exhaust muffler 76 is connected to the downstream end of the exhaust pipe 75. An exhaust outlet 76*a* of the exhaust muffler 76 is placed to face the exhaust gas outlet 15*a* of the rear cover 15.

The fuel tank 32 has a fuel outlet 32*d* on a lower part thereof. Fuel is fed from the fuel outlet 32*d* to the carburetor 73 which is positioned above the fuel outlet 32*d*, by means of a fuel pump 78 supported on the inner face of an upper part of the right reinforcing frame 27. A fuel cock 79 and an engine switch 80 are supported on the outer face of a lower part of the right reinforcing frame 27. The fuel cock 79 is connected to the fuel outlet 32*d* of the fuel tank 32 via a fuel pipeline 81 and also to an inlet 78*a* of the fuel pump 78 via a fuel pipeline 82. An operating knob 79*a* for opening and closing the fuel cock 79 runs through the right side cover 13 and is exposed externally.

The fuel pump 78 is of a diaphragm type in which a pumping operation is carried out in response to pressure pulsations generated within the crank chamber 43 of the engine main body 41. An outlet 78*b* of the fuel pump 78 is connected to the carburetor 73 of the intake system 74 via a fuel pipeline 83 and the pressure pulsations generated within the crank chamber 43 are transmitted to the fuel pump 78 via the pressure pipeline 84.

The engine E is covered with a shroud 85, which is formed by joining left and right shroud halves 86 and 87 made of a synthetic resin. The left shroud half 86 is secured to the left side faces of the crankcase 45 and the cylinder barrel 47 of the engine main body 41 by means of bolts 88. The right shroud half 87 is secured to the right side faces of the crankcase 45 and the cylinder barrel 47 by means of bolts 89.

The shroud 85 is formed so that it is open at the front and rear. The exhaust muffler 76 is disposed in the rear aperture of the shroud 85. A die-cast aluminum fan cover 90 is fitted around the front aperture to cover the generator G and the cooling fan 61. The upper part of the fan cover 90 is secured to the cylinder head 50 of the engine main body 41 by a bolt 91, and the lower part of the fan cover 90 is secured to the crankcase 45 of the engine main body 41 by bolts 92.

Fixed to a central aperture of the fan cover 90 by means of a plurality of bolts 93 is a recoil starter cover 95 for a recoil starter 94. The recoil starter 94 includes the recoil starter cover 95, a reel 96 rotatably supported on the recoil starter cover 95, a cable 97, an operating knob 98, and a drive member 99 provided on the reel 96 so that it can engage with a driven member 61*a* that is integral with the cooling fan 61. One end of the cable 97 is wound around the reel 96. The other end of the cable 97 runs through the right reinforcing frame 27 and the right side cover 13 and is provided with the operating knob 98.

Cooling air inlets 95*a* are formed in the recoil starter cover 95. Moreover, a cooling air inlet 100 is formed between the lower end of the recoil starter cover 95 and the lower part of the shroud 85.

When the reel 96 is rotated by pulling the cable 97 by means of the operating knob 98, the drive member 99 engages with the driven member 61*a* by means of a cam mechanism (not illustrated), thus rotating the cooling fan 61 and thereby cranking the crankshaft 44 connected to the cooling fan 61 via the flywheel 62 to start the engine E. When the operating knob 98 is released, the drive member 99 disengages from the driven member 61*a*, and the reel 96 returns to its original position due to the spring force of a return spring (not illustrated) while winding up the cable 97.

A mounting bracket 101 is fixed to the lower rear part of the crankcase 45 of the engine main body 41. The mounting bracket 101 is resiliently supported on a mounting rib 16*a* provided on the upper face of a rear part of the under cover 16 of the case 11. A mounting bracket 90*a* is formed integrally on the lower part of the fan cover 90. The mounting bracket 90*a* is resiliently supported on a mounting rib 16*b* provided on the upper face of a front part of the under cover 16 of the case 11.

Figure 8:
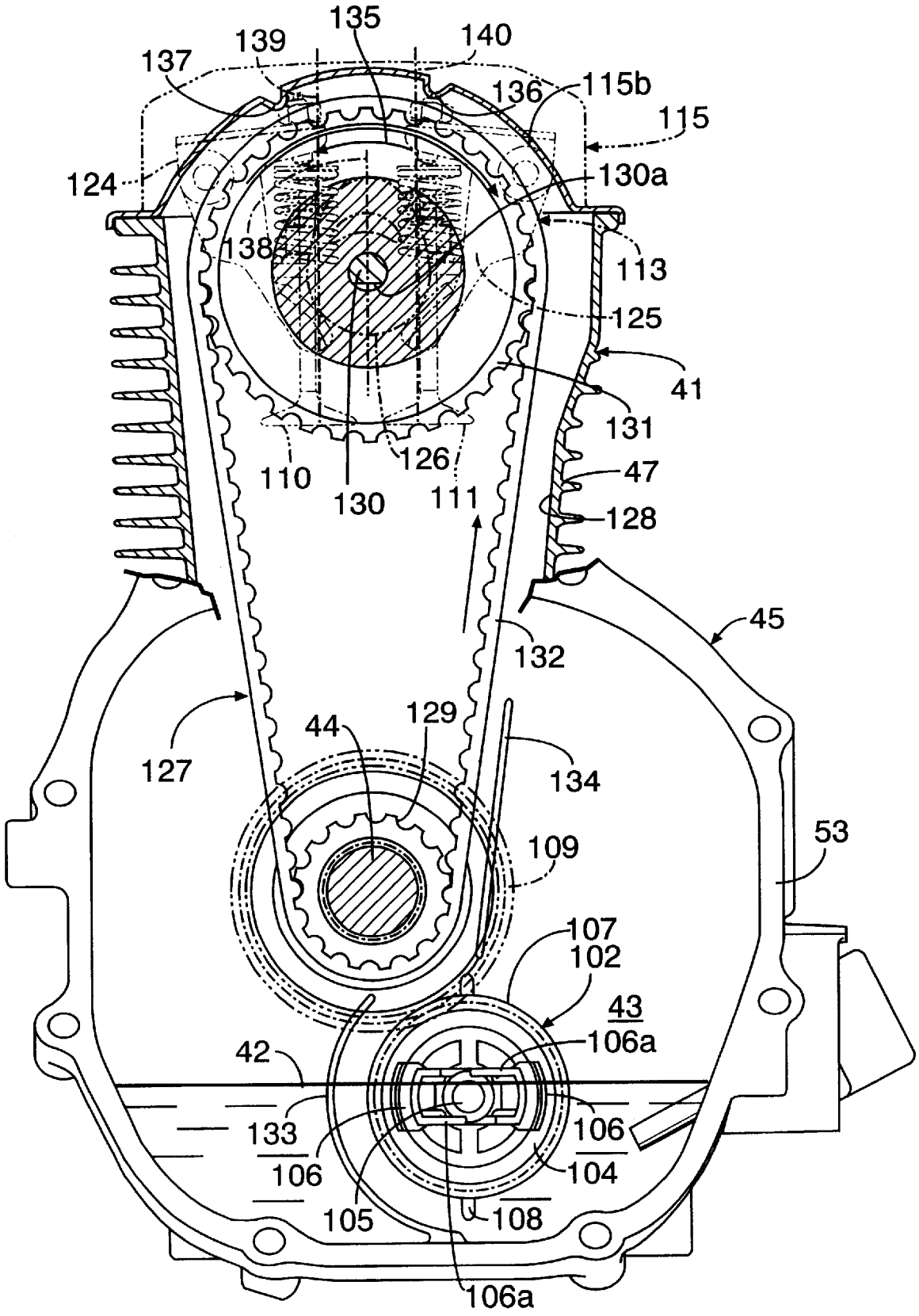

Referring also to FIG. 8, a centrifugal speed governor 102 is mounted on the second case half 53 of the crankcase 45 in a position that is beneath the crankshaft 44 when the generator G is in use. The centrifugal governor 102 is formed from a rotary disc 104, a tubular slider 105 and a pair of pendular centrifugal weights 106. The rotary disc 104 is rotatably supported by a support shaft 103 fixed to the inner face of the second case half 53. The slider 105 is slidably fitted around the support shaft 103. The centrifugal weights 106 are swingably supported on the rotary disc 104 with the slider 105 interposed between the weights 106. Each of the centrifugal weights 106 is provided with an operating arm 106*a* that slides the slider 105 in one direction when the corresponding centrifugal weight 106 swings outward in the radial direction of the rotary disc 104 due to centrifugal force.

A driven gear 107 and oil splashing vanes 108 are formed integrally around the outer circumference of the rotary disc 104. The driven gear 107 is meshed with a drive gear 109 fixed to the crankshaft 44. The support shaft 103 is provided in the second case half 53 at a position such that the oil splashing vanes 108 on the outer circumference of the rotary disc 104 are immersed in the oil 42 within the crank chamber 43.

In the centrifugal speed governor 102, the slider 105 slides in one axial direction of the support shaft 103 in response to rotation of the rotary disc 104 accompanying the rotation of the crankshaft 44. The sliding action of the slider 105 is transmitted to a throttle valve (not illustrated) of the carburetor 73 via a link (not illustrated), thereby controlling the engine rotational speed at a predetermined value.

An intake valve 110 and an exhaust valve 111 are disposed in the cylinder head 50 so that they can be made to open and close, the intake valve 110 controlling the provision and blockage of communication between the intake port 70 and the combustion chamber 49, and the exhaust valve 111 controlling the provision and blockage of communication between the combustion chamber 49 and the exhaust port 71. The cylinder head 50 is also provided with a spark plug 112 facing the interior of the combustion chamber 49.

Figure 9:
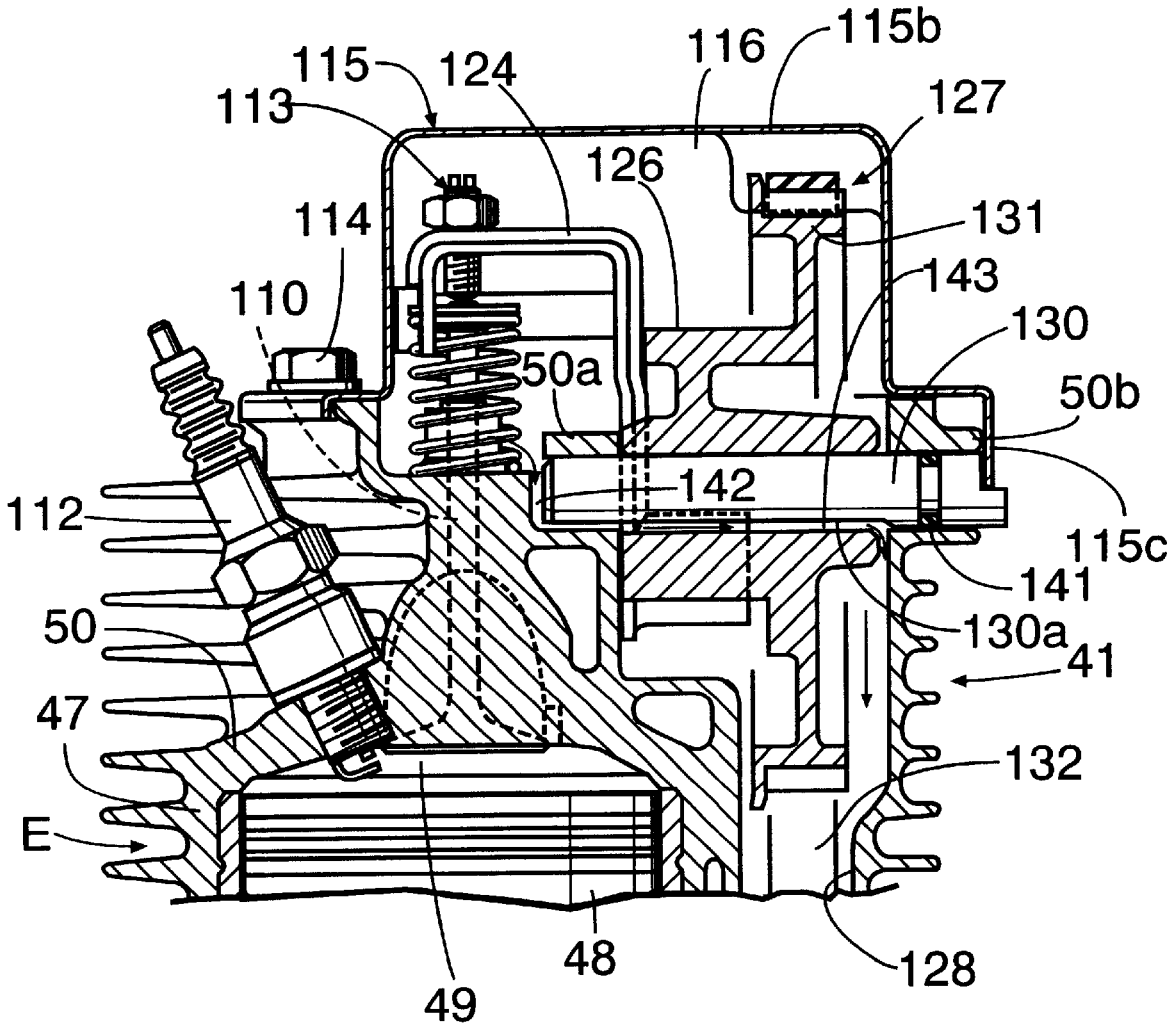

Referring also to FIG. 9, the intake valve 110 and the exhaust valve 111 are made to open and close by a valve operation system 113. The valve operation system 113 is housed in a valve operation chamber 116 formed between the cylinder head 50 and a head cover 115 secured to the cylinder head 50 by a plurality of bolts 114.

The head cover 115 projects upward through an aperture 117 formed between the upper parts of the shroud 85 and the fan cover 90. Provided integrally on the front part of the head cover 115 is an air guide plate 119 forming an air guide passage 118 between the front part of the cylinder head 50 and itself. A guide member 120 for inserting the spark plug 112 into the cylinder head 50 and removing it therefrom is attached to the air guide plate 119. The aperture of the upper end of the guide member 120 is blocked with a detachable cap 121. An ignition coil 122 is mounted on the upper part of the fan cover 90 in the vicinity of the spark plug 112.

A plate-form support 115*a* is projectingly provided on the head cover 115. The support 115*a* is resiliently supported by the left and right side covers 12 and 13.

The valve operation system 113 housed in the valve operation chamber 116 includes intake side and exhaust side rocker arms 124 and 125 and a valve-operating cam 126 rotatably supported by the cylinder head 50 so as to be in sliding contact with these rocker arms 124 and 125. The intake side and exhaust side rocker arms 124 and 125 are operatively connected to the intake valve 110 and the exhaust valve 111 respectively and rockably supported in the head cover 115.

Provided between the valve-operating cam 126 of the valve operation system 113 and the crankshaft 44 is a timing transmitting means 127 for transmitting the rotational power of the crankshaft 44 to the valve-operating cam 126 with a reduction in speed of ½. The timing transmitting means 127 is housed in a housing passage 128 provided in the cylinder barrel 47 and the cylinder head 50 of the engine main body 41, the housing passage 128 connecting the valve operation chamber 116 and the crank chamber 43.

The timing transmitting means 127 includes a drive timing pulley 129, a driven timing pulley 131 as the driven wheel, and an endless timing belt 132. The drive timing pulley 129 is fixed to the crankshaft 44. The driven timing pulley 131 is a driven wheel rotatably supported on the support shaft 130 fixedly supported in the cylinder head. The endless timing belt 132 is wrapped around the drive timing pulley 129 and the driven timing pulley 131. The driven timing pulley 131 is formed integrally with the valve-operating cam 126 of the valve operation system 113.

The timing transmitting means 127 can supply the oil 42 within the crank chamber 43 to the valve operation chamber 116 by means of the oil attached to and accompanying the timing belt 132. The second case half 53 of the crankcase 45 is provided with a guide wall 133 and a guide wall 134. The guide wall 133 is curved so as to cover the side of the centrifugal governor 102 beneath the timing transmitting means 127, thereby guiding the oil 42 splashed up by the oil splashing vanes 108 of the centrifugal governor 102 to the lower part of the timing transmitting means 127. The guide wall 134 faces the timing belt 123 in the lower part of the timing transmitting means 127 to guide to the timing belt 123 side, the splashed oil that has collided with the guide wall 133.

The oil thus attached to the timing belt 132 is thereby splashed within the valve operation chamber 116 from the timing belt 132 due to the action of inertial force and centrifugal force in the section where the timing belt 132 is wrapped around the timing pulley 131. Provided in the head cover 115 is a curved cover part 115*b* that is retained in an arc form so as to cover the upper part of the driven timing pulley 131. Provided integrally on the curved cover part 115*b* are a plurality, for example, a pair of oil splashing ribs 136 and 137 at intervals along the rotational direction 135 of the driven timing pulley 131 to project toward the side that is closer to the timing belt 132.

The intake side and exhaust side rocker arms 124 and 125 of the valve operation system 113 are individually in sliding contact with the lower part of the valve-operating cam 126 at positions on opposite sides of, and an equal distance from, a vertical line 138 passing through the rotational axis of the valve-operating cam 126. In a projection on a vertical plane that is orthogonal to the rotational axis of the valve-operating cam 126 (a plane parallel to the plane of the paper in FIG. 8), the pair of oil splashing ribs 136 and 137 are placed outside a pair of vertical lines 139 and 140 that pass through the parts of the rocker arms 124 and 125 that are in sliding contact with the valve-operating cam 126. The oil splashing ribs 136 and 137 are provided integrally with the curved cover part 115*b* so as to extend in a directions orthogonal to the rotational direction 135 of the driven timing pulley 131.

Provided on the upper part of the cylinder head 50 are an internal shaft support 50*a* and an external shaft support 50*b* with the housing passage 128 interposed therebetween. The internal shaft support 50*a* supports one end of the support shaft 130 that rotatably supports the valve-operating cam 126 and the driven timing pulley 131, which are integral with each other. The external shaft support 50*b* supports the other end of the support shaft 130. An annular seal 141 is disposed between the shaft support 50*b* and the support shaft 130.

The other end of the support shaft 130 is positioned so as to face outside the cylinder head 50. An engagement plate 115*c* provided in the head cover 115 engages with the other end of the support shaft 130, thereby preventing the support shaft 130 from moving away from the cylinder head 50 and from rotating about its axis.

Provided between the internal shaft support 50*a* and the one end of the support shaft 130 is an oil intake passage 142 the upper end of which opens upward on the base of the valve operation chamber 116 and lower end of which is closed. Provided on the outside of the lower part of the support shaft 130 is a flat surface 130*a* that extends from the one end of the support shaft 130 to a position corresponding to the external shaft support 50*b*. Formed between the flat surface 130*a* and the valve-operating cam 126 and driven timing pulley 131 is an oil passage 143, one end of which communicates with the oil intake passage 142. The other end of the oil passage 143 opens downward between the external shaft support 50*b* and the driven timing pulley 131 and communicates with the housing passage 128 housing the timing transmitting means 127.

Figure 10:
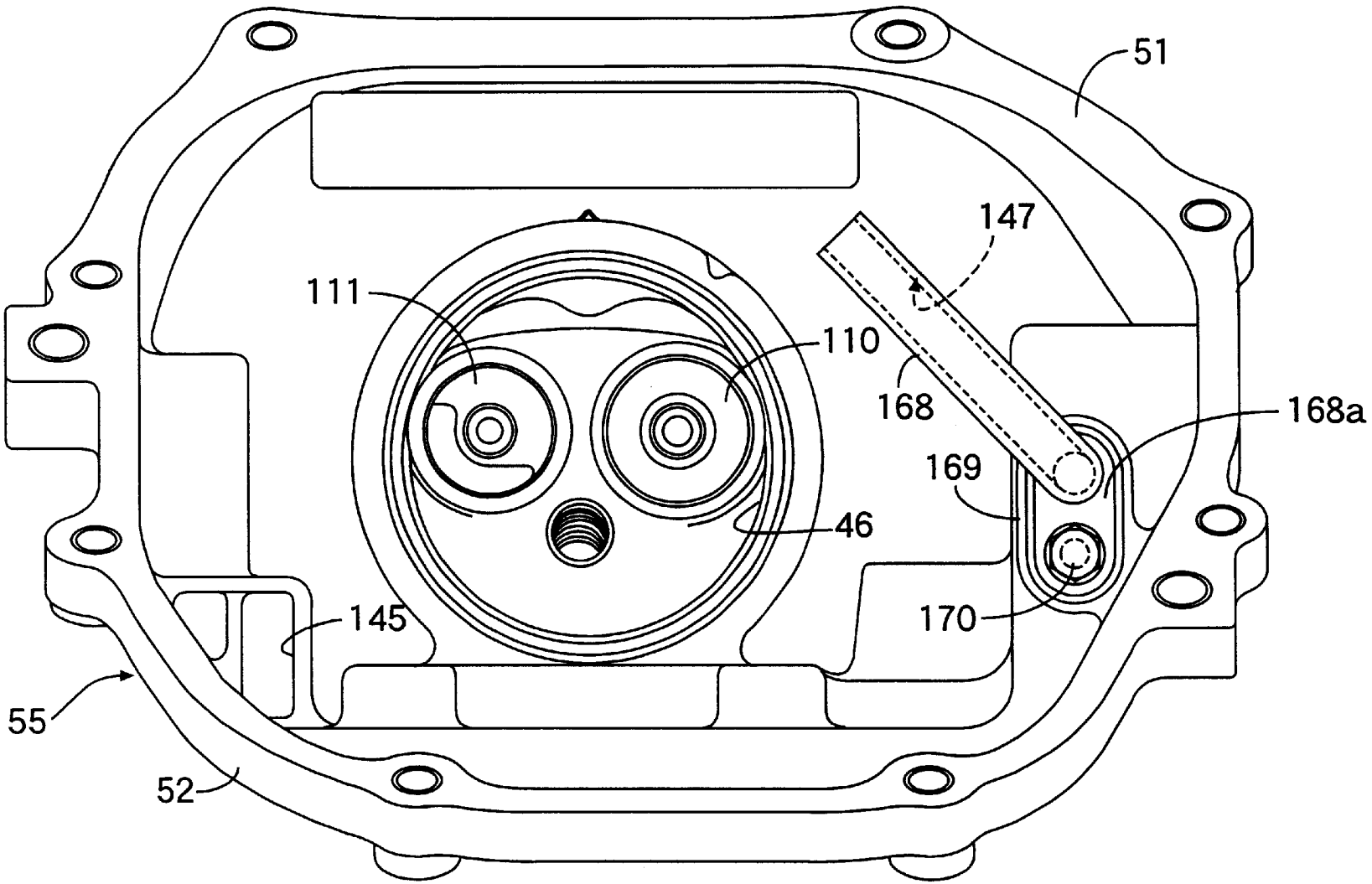
Figure 11:
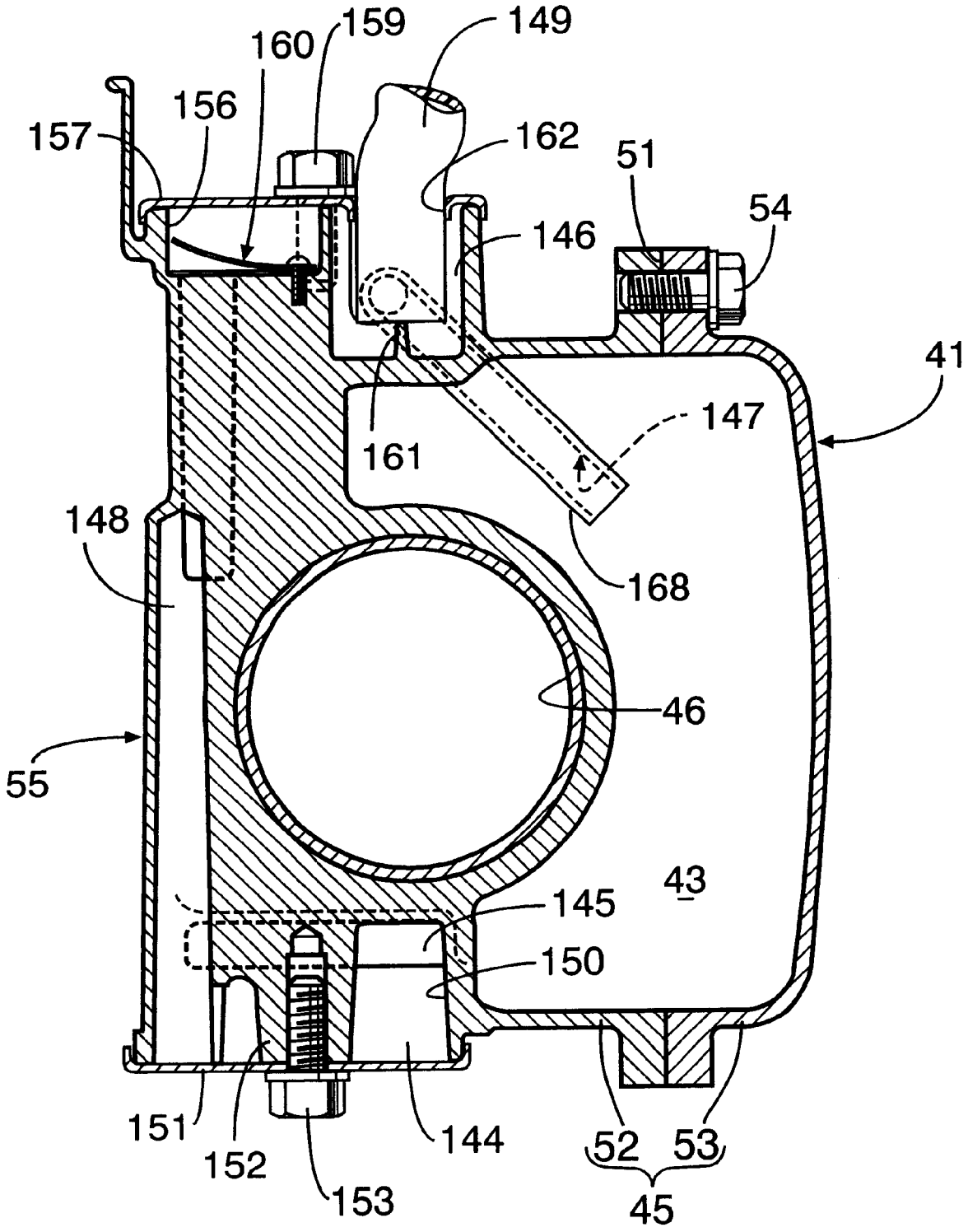

Referring also to FIGS. 10 and 11, the engine block 55 in the engine main body 41 is provided with a first breather chamber 144, a first communicating passage 145, a second breather chamber 146, a second communicating passage 147, and a connecting passage 148 connecting the first and second breather chambers 144 and 146. The first breather chamber 144 is placed at a position that is approximately 180° from a position corresponding to the intake system 74 along the circumferential direction of the cylinder bore 46. The first communicating passage 145 provides communication between the first breather chamber 144 and the interior of the crank chamber 143. The second breather chamber 146 is positioned in the vicinity of the intake system 74 on the side substantially opposite to the first breather chamber 144 relative to the axis of the cylinder bore 46. The second communicating passage 147 provides communication between the second breather chamber 146 and the interior of the crank chamber 43. The second breather chamber 146 is connected to the air cleaner 72 of the intake system 74 via a gas pipeline 149 such as a rubber hose.

Figure 12:
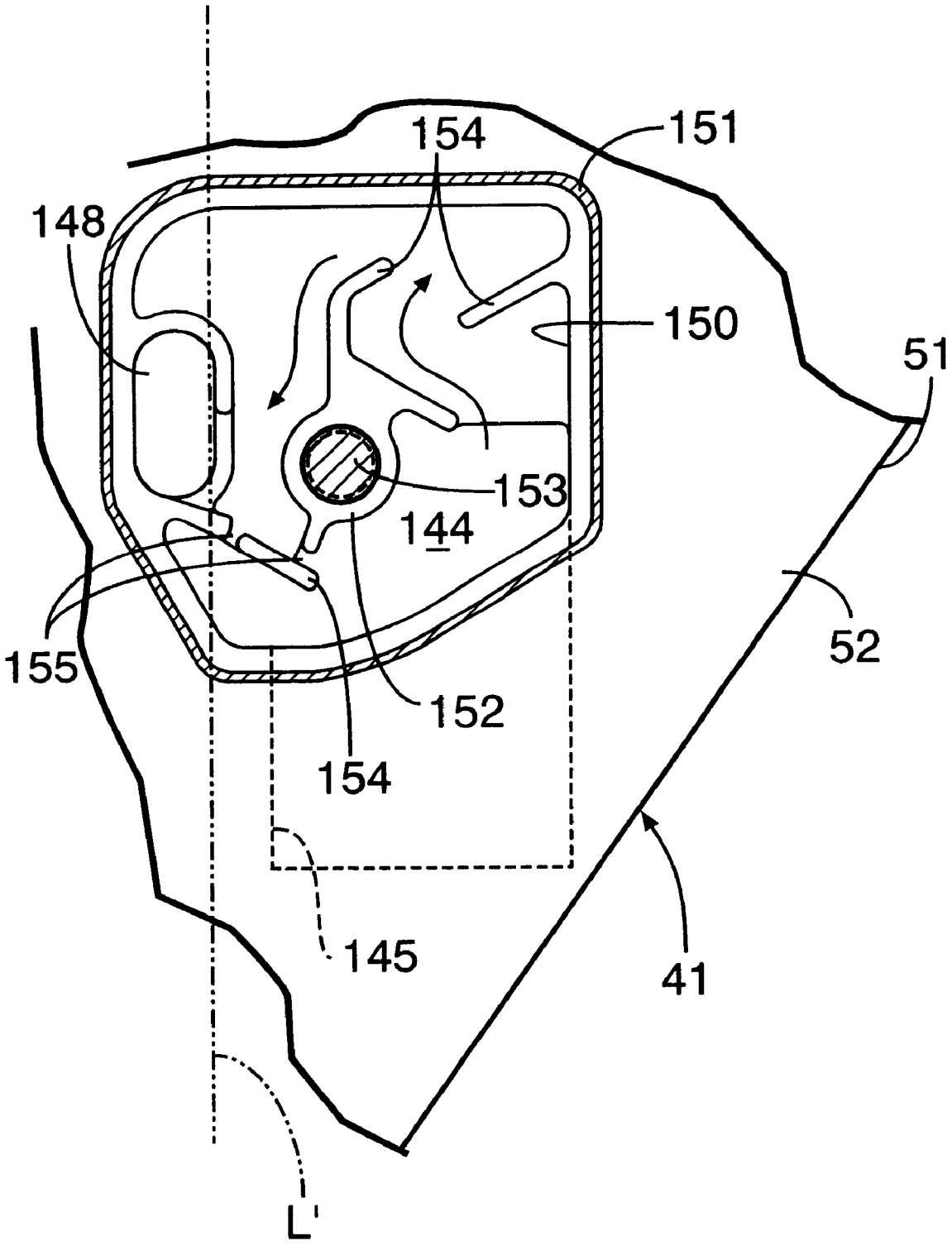

Referring also to FIG. 12, a recess 150 is provided on the outside of the first case half 52 in the engine block 55 on the side opposite to the side where the intake system 74 is placed. A cover 151 for covering the recess 150 is secured to the outside of the first case half 52. The first breather chamber 144 is thereby formed between the first case half 52 and the cover 151, the first breather chamber 144 being positioned above the oil level within the crank chamber 43 when the generator G is in use. The first communicating passage 145 communicates with the lower part of the first breather chamber 144 when the generator G is in use and is bored in the first case half 52 so that its open end in the crank chamber 43, is divided into two.

The connecting passage 148 is provided in the first case half 52 so that it is positioned in a plane that is orthogonal to the axis of the cylinder bore 46. One end of the connecting passage 148 opens within the recess 150 so as to communicate with the first breather chamber 144.

A boss 152 is projectingly provided on the outside of the first case half 52 in a substantially central part within the recess 150. The cover 151 is secured to the first case half 52 by a bolt 153 that is screwed into the boss 152. Furthermore, projectingly provided on the outside of the first case half 52 within the recess 150 are a plurality of labyrinth-forming walls 154 that are in contact with the cover 151. These labyrinth-forming walls 154 form a labyrinth providing communication between the first communicating passage 145 and the connecting passage 148. When the generator G is in use, the breather gas enters the first breather chamber 144 from the crank chamber 43 via the first communicating passage 145 and then reaches the connecting passage 148 through the labyrinth within the first breather chamber 144. The accompanying oil is separated from the breather gas while the breather gas changes its direction of flow in the labyrinth. That is to say, the first breather chamber 144 is formed to have a gas-liquid separation mechanism. Moreover, provided in the labyrinth-forming walls 154 that are positioned lower than the open end of the connecting passage 148 in a section of the labyrinth on the connecting passage 148 side are return holes 155 whose flow areas are narrowed to suppress the flow of the breather gas to a minimum, the return holes 155 returning the separated oil to the first communicating passage 145 side.

Figure 13:
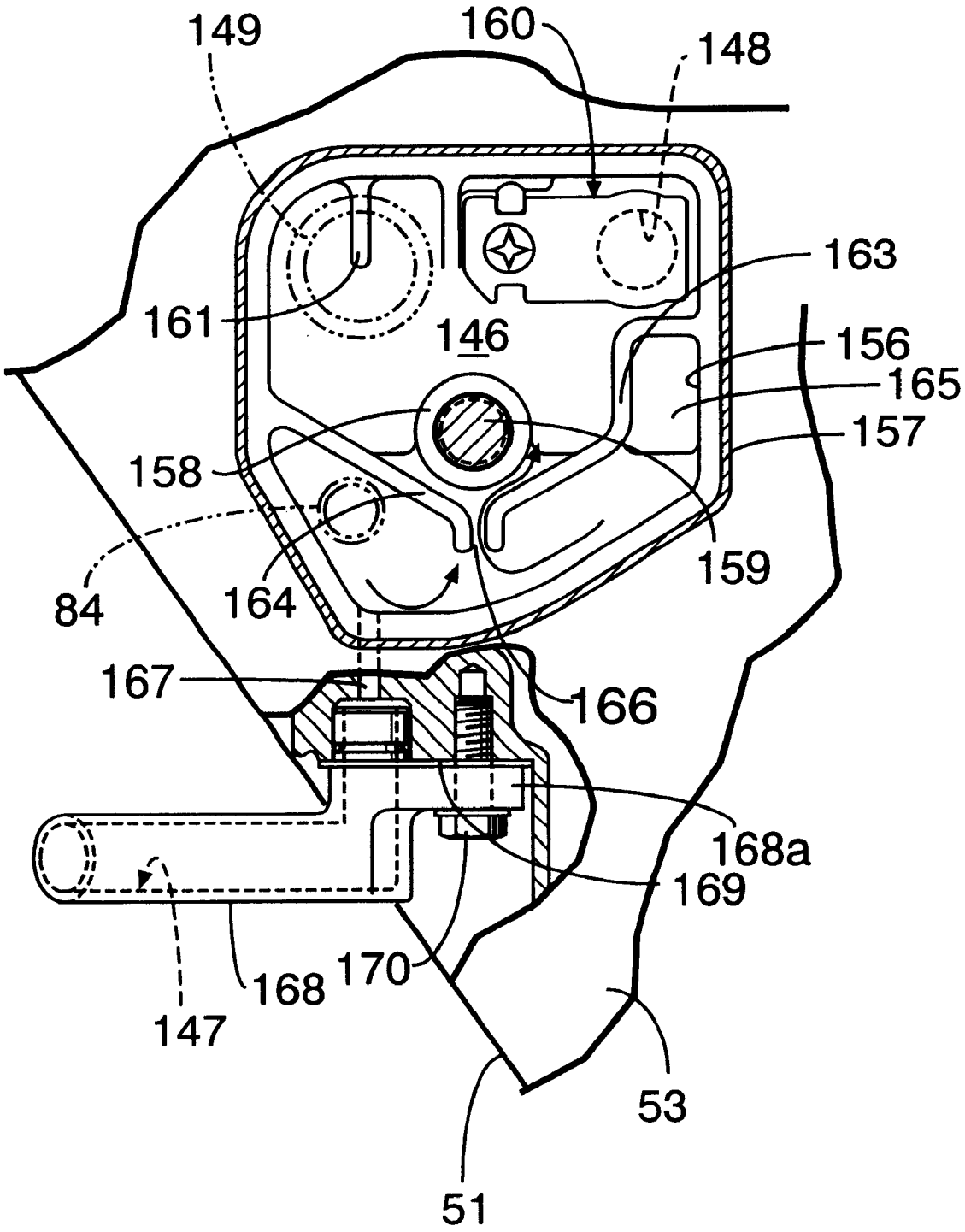

Referring also to FIG. 13, provided on the outside of the first case half 52 in the engine block 55 is a recess 156 positioned in the vicinity of the intake system 74 at the side substantially opposite to the first breather chamber 144 relative to the axis of the cylinder bore 46. A cover 157 for covering the recess 156 is secured to the outside of the first case half 52. The second breather chamber 146, which is positioned above the oil level within the crank chamber 43 when the generator G is in use, is thereby formed between the first case half 52 and the cover 157. The other end of the connecting passage 148 opens in the recess 156 so as to communicate with the upper part of the second breather chamber 146 when the generator G is in use.

A boss 158 is projectingly provided on the outside of the first case half 152 in substantially the central part within the recess 156. The cover 157 is secured to the first case half 52 by a bolt 159 screwed into the boss 158. Mounted on the first case half 52 within the recess 156 is a reed valve 160 that inhibits the flow of breather gas from the second breather chamber 146 to the connecting passage 148 side, in a manner such that it blocks the open end at the other end of the connecting passage 148.

A projection 161 is projectingly provided on the outside of the first case half 52 in an area to the side of the connecting passage 148 that, when the generator G is in use, is on the upper part of the second breather chamber 146. The projection 161 receives one end of the gas pipeline 149 fitted in an airtight manner in a through hole 162 provided in the cover 157, in a manner such that the whole opening at the one end of the gas pipeline 149 is not closed.

Projectingly provided on the outside of the first case half 52 within the recess 156 are labyrinth-forming walls 163 and 164, which are in contact with the cover 157. One labyrinth-forming wall 163 forms a labyrinth providing a connection between the connecting passage 148 and the gas pipeline 149 within the second breather chamber 146. The other labyrinth-forming wall 164 forms a labyrinth providing a connection between the second communicating passage 147 and the gas pipeline 149 within the second breather chamber 146. These labyrinths allow the second breather chamber 146 also to have a gas-liquid separation mechanism.

One end of a pressure pipeline 84 is connected to the cover 157 to communicate with the second breather chamber 146 beneath the labyrinth-forming walls 163 and 164. The other end of the pressure pipeline 84 is connected to the fuel pump 78. On the lower part of the labyrinth-forming walls 163 and 164 within the second breather chamber 146 there opens a branch passage 165 that branches off from the connecting passage 148 to bypass the reed valve 160. Formed between the lower parts of the labyrinth-forming walls 163 and 164 is a throttle hole 166 that is disposed between the upper and lower parts of the labyrinth-forming walls 163 and 164 within the second breather chamber 146.

The second communicating passage 147 communicates with the lower part of the second breather chamber 146 when the generator G is in use and is formed from a passage hole 167 and a pipe 168. The passage hole 167 is bored directly in the first case half 52 to communicate with the second breather chamber 146. The pipe 168 is secured to the first case half 52 to communicate with the passage hole 167. A flat mounting seat 169 is formed on the first case half 52, in a part that is positioned beneath the second breather chamber 146 when the generator G is in use, to face the crank chamber 168. The passage hole 167 is bored in the first case half 52, providing a connection between the second breather chamber 146 and the mounting seat 169. The pipe 168 is made in a substantially L-shaped form having a flange part **168*a* that is in contact with the mounting seat 169. The flange part 168*a* is secured to the mounting seat 169 by a bolt 170, and one end of the pipe 168 is fitted in a liquid-tight manner to an end, on the mounting seat 169 side, of the passage hole 167**.

Figure 14:
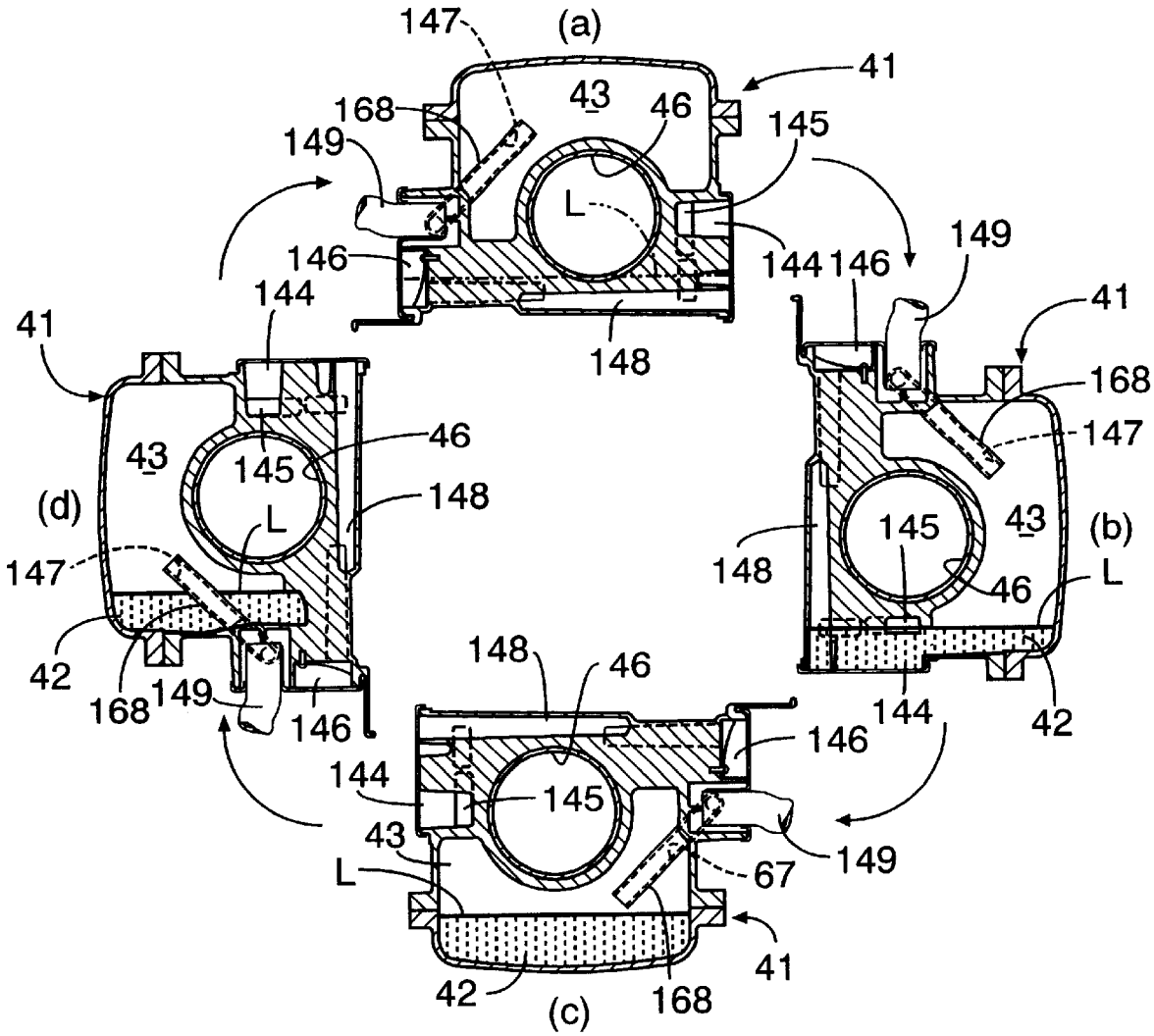

When the generator G is not in use, as shown in FIG. 14, the engine main body 41 can be in a laid-sideways attitude so that the axis of the cylinder bore 46 is substantially horizontal. The second communicating passage 147 is formed so that the open end thereof within the crank chamber 43 is always above the oil level L within the crank chamber 43 regardless of the attitude of the engine main body 41 as shown in FIGS. 14A to 14D when the engine main body 41 is in a laid-sideways state where the axis of the cylinder bore 46 is substantially horizontal.

In a state in which the engine main body 41 is in a laid-sideways state in which the connecting passage 148 is positioned beneath the axis of the cylinder bore 46, that is, in a state shown in FIG. 14A, the oil level L of the oil 42 is at a position that allows the oil 42 to be guided into the first breather chamber 144 via a section of the first communicating passage 145. There is therefore a possibility that the oil 42 might flow from the first breather chamber 144 to the second breather chamber 146 side via the connecting passage 148. However, the route extending from the first communicating passage 145 to the connecting passage 148 via the first breather chamber 144 is formed in a shape that prevents the oil 42 within the crank chamber 43 from entering the connecting passage 148. That is, in the present embodiment, the oil level is at a position denoted by the broken chain line L in FIG. 12 when the engine main body 41 is in a laid-sideways state in which the connecting passage 148 is positioned beneath the axis of the cylinder bore 46, and the labyrinth-forming walls 154 provided in the first case half 52 for forming the labyrinth within the first breather chamber 144 are formed in a shape that prevents the oil 42 that has flowed into the first breather chamber 144 through the first communicating passage 145 from entering the connecting passage 148.

The action of the present embodiment is explained below. The first case half 52 of the engine main body 41 is provided with the first breather chamber 144, the first communicating passage 145 that provides communication between the first breather chamber 144 and the crank chamber 43, the second breather chamber 146 that is placed in the vicinity of the intake system 74 on the side that is substantially opposite to the first breather chamber 144 relative to the axis of the cylinder bore 46, the second communicating passage 147 that provides communication between the second breather chamber 146 and the crank chamber 43, and the connecting passage 148 that provides a connection between the first and second breather chambers 144 and 146, so that the first and second communicating passages 145 and 147 communicate with the lower parts of the first and second breather chambers 144 and 146 that are positioned above the oil level L within the crank chamber 43 when the generator G is in use and the connecting passage 148 opens in the upper part of the second breather chamber 146. The gas pipeline 149 communicating with the upper part of the second breather chamber 146 when the generator G is in use is connected to the air cleaner 72 of the intake system 74.

The breather gas generated in the crank chamber 43 is therefore guided, when the generator G is in use, from the first communicating passage 145 to the intake system 74 via the first breather chamber 144, the connecting passage 148, the second breather chamber 146 and the gas pipeline 149 and also from the second communicating passage 147 to the intake system 74 via the second breather chamber 146 and the gas pipeline 149.

Moreover, since the labyrinths are formed within the first and second breather chambers 144 and 146, the oil can be separated from the breather gas while passing through the labyrinths and returned to the crank chamber 43 via the first and second communicating passages 145 and 147, thereby enhancing the gas-liquid separation performance.

Furthermore, since the second communicating passage 147 is formed so that the open end of the second communicating passage 147 within the crank chamber 43 is positioned above the oil level L within the crank chamber 43 regardless of the attitude of the engine main body 41 when the engine main body 41 is in a laid-sideways state where the axis of the cylinder bore 46 is substantially horizontal, the oil 42 within the crank chamber 43 can be prevented from entering the second breather chamber 146 via the second communicating passage 147 regardless of the attitude of the engine main body 41 when the engine main body 41 is laid sideways where the axis of the cylinder bore 46 is substantially horizontal.

Furthermore, since the route from the first communicating passage 145 to the connecting passage 148 via the first breather chamber 144 is formed in a shape that can prevent the oil 42 within the crank chamber 43 from entering the connecting passage 148 when the engine main body 41 is in a laid-sideways state in which the connecting passage 148 is positioned beneath the axis of the cylinder bore 46, the oil 42 within the crank chamber 43 does not enter the second breather chamber 146 from the first communicating passage 145 via the first breather chamber 114 and the connecting passage 148.

The oil 42 within the crank chamber 43 therefore does not enter the second breather chamber 146 regardless of the attitude of the engine main body 41 when it is in a laid-sideways state so that the axis of the cylinder bore 46 is substantially horizontal, and it is possible to reliably prevent the oil 42 from entering the intake system 74 and this contributes to an enhancement of the exhaust performance while discharging no white smoke through the exhaust muffler 40 when starting the engine E.

Moreover, the first and second breather chambers 144 and 146 are provided in the engine main body 41, and the overall dimensions of the engine E do not increase.

Furthermore, the second communicating passage 147 is formed from the passage hole 167 that is bored directly in the first case half 52 of the engine main body 41 to communicate with the second breather chamber 146, and the pipe 168 secured to the first case half 52 communicates with the passage hole 167. It is possible to easily form the second communicating passage 147 having a complicated shape that allows its open end to be positioned above the oil level within the crank chamber 43 regardless of the attitude of the engine main body 41 when the engine main body 41 is in a laid-sideways state so that the axis of the cylinder bore 46 is substantially horizontal.

The fuel tank 32 is positioned on the side of the engine main body 41, thereby making the portable engine-operated machine lower and more compact. It can therefore be carried around easily, thereby enhancing the user convenience.

Furthermore, since the fuel pump 78, which is required because the fuel exit 32*a* of the fuel tank 32 is positioned lower than the carburetor 73, is of a diaphragm type, the pressure pulsations generated within the crank chamber 43 of the engine E can be utilized effectively to drive the fuel pump 78. Moreover, since the pressure pipeline 84 for transmitting the pressure pulsations to the fuel pump 78 is connected to the second breather chamber 146, as in the case of the breather gas, the pressure pulsations generated in the crank chamber 43 are transmitted from the first communicating passage 145 to the pressure pipeline 84 via the first breather chamber 144, the connecting passage 148, and the second breather chamber 146 and act on the fuel pump 78, thereby preventing the oil from entering the fuel pump 78 as far as is possible.

The gas-liquid separation mechanism is thus shared by the breather gas and the fuel pump 78 and its installation in the engine main body 41 can be rationalized, thereby simplifying the structure of the engine main body 41 and making it more compact.

The valve operation system 113 is housed in the valve operation chamber 116 formed between the cylinder head 50 and the head cover 115 of the engine E. The power from the crankshaft 44 is transmitted to the valve operation system 113 via the timing transmitting means 127 having the driven timing pulley 131 and the timing belt 132 wrapped around the driven timing pulley 131, which is rotated together with the valve-operating cam 126 of the valve operation system 113. The oil 42 is supplied to the valve operation chamber 116 by the oil 42 within the crankcase 43 accompanying the timing belt 132.

Moreover, the arc-shaped curved cover part 115*b* covering the upper part of the driven timing pulley 131 is provided on the head cover 115, and a plurality (a pair in this embodiment) of oil splashing ribs 136 and 137 are provided integrally with the curved cover part 115*b* above the driven timing pulley 131 at intervals along the rotational direction 135 of the driven timing pulley 131 so as to project toward the timing belt 132.

When the oil that has been conveyed to the valve operation chamber 116 while attached to the timing belt 132 is separated from the timing belt 132 due to the action of inertial force and centrifugal force, the oil so detached collides with the oil splashing ribs 136 and 137 and is atomized. Since the oil splashing ribs 136 and 137 are provided on the curved cover part 115*b* of the head cover 115 at a plurality of positions at intervals along the rotational direction 135 of the driven timing pulley 131, the oil that has passed by one oil splashing rib 136 collides with the following oil splashing rib 137 and is splashed, thereby reliably splashing the oil at a plurality of positions and ensuring that the oil can reliably reach each part of the valve operation system 113. The oil splashing ribs 136 and 137 also have the function of reinforcing the head cover 115.

The intake side and exhaust side rocker arms 124 and 125 of the valve operation system 113 are in sliding contact with the lower part of the valve-operating cam 126 at positions on opposite sides of, and an equal distance from, the vertical line 138 passing through the rotational axis of the valve-operating cam 126. In the projection on the vertical plane that is orthogonal to the rotational axis of the valve-operating cam 126, the pair of oil splashing ribs 136 and 137 are placed outside the pair of vertical lines 139 and 140 that pass through the parts of the two rocker arms 124 and 125 where they are in sliding contact with the valve-operating cam 126. The oil that has collided with the oil splashing rib 136 and been splashed is supplied effectively to the area where the exhaust side rocker arm 125 slides on the valve-operating cam 126. The oil that has collided with the oil splashing rib 137 and been splashed is supplied effectively to the area where the intake side rocker arm 124 slides on the valve-operating cam 126. The valve operation system 113 can thereby be lubricated reliably by a small number of oil splashing ribs 136 and 137.

Each of the oil splashing ribs 136 and 137 is provided integrally with the curved cover part 115*b* to extend in a direction orthogonal to the rotational direction 135 of the driven timing pulley 131. The oil can collide with the oil splashing ribs 136 and 137 at right angles, thereby splashing the oil in an atomized manner.

Furthermore, the valve-operating cam 126 of the valve operation system 113 and the driven timing pulley 131 of the timing transmitting means 127 are formed integrally with each other and are rotatably supported by the support shaft 130, the opposite ends of the support shaft 130 being fixedly supported in the cylinder head 50, which is an upper part of the engine main body 41.

Provided between the cylinder head 50 and one end of the support shaft 130 is the oil intake passage 142 the upper end of which opens upward on the base of the valve operation chamber 116 and the lower end of which is closed. Provided on the outside of the lower part of the support shaft 130 is the flat surface 130*a* that forms the oil passage 143 between the flat surface 130*a* and the valve-operating cam 126 and driven timing pulley 131, one end of the oil passage 143 communicating with the oil intake passage 142. The other end of the oil passage 143 opens downward and communicates with the housing passage 128 housing the timing transmitting means 127.

In accordance with the above-mentioned arrangement, together with the use of the splash lubrication system in which the oil that has been splashed in and fills the valve operation chamber 116, falls down within the valve operation chamber 116 and is guided to the oil intake passage 142 by free fall, the oil is further guided from the oil intake passage 142 to one end of the oil passage 143 that is formed between the outside of the lower part of the support shaft 130 and the valve-operating cam 126 and driven timing pulley 131. The oil can further flow from the other end of the oil passage 143 toward the housing passage 128 and return to the lower part of the engine main body 41.

The oil passage 142 is formed by providing the flat surface 130*a* on the outside of the lower part of the support shaft 130 and, while suppressing any increase in the machining cost by simplifying the machining of the support shaft 130, setting the flow areas of the oil intake passage 142 and the oil passage 143 to be comparatively large allows a sufficient amount of oil to be supplied to the lubrication area between the support shaft 130 and the valve-operating cam 126 and driven timing pulley 131, thereby suppressing the generation of heat due to rotation at higher speed.

The application of the present invention is not limited to an OHC engine for an engine generator but the present invention can be put into practice widely in relation to an OHC engine.

Although an embodiment of the present invention has been explained above, the present invention is not limited by the above-mentioned embodiment, and the present invention can be modified in a variety of ways without departing from the spirit and scope of the present invention described in the appended claims.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A lubrication structure in an OHC engine having a cylinder head, a head cover connected to the cylinder head, a valve operation chamber formed between the cylinder head and the head cover, an intake valve, an exhaust valve, a crankshaft, and a crankcase, the lubricating structure comprising:

a valve operation system housed in the valve operation chamber, the valve operation system comprising a valve-operating cam rotatably supported by the cylinder head and is cooperatively connected to the intake valve and the exhaust valve; and timing transmitting means disposed between the valve operation system and the crankshaft, the timing transmitting means comprising a driven wheel rotating together with the valve-operating cam and a transmission belt wrapped around the driven wheel, wherein oil within the crankcase, is carried by the transmission belt and is supplied to the valve operation chamber;

wherein the head cover includes an arc-form curved cover part for covering the upper part of the driven wheel;

wherein the curved cover part integrally comprises above the driven wheel a plurality of oil splashing ribs positioned at intervals along the rotational direction of the driven wheel projecting toward the side that is closer to the transmission belt; and wherein each of the oil splashing ribs is integral with the curved cover part and extends in a direction orthogonal to the rotational direction of the driven wheel, thereby reinforcing said head cover.

2. The lubrication structure in an OHC engine according to claim 1, wherein the valve operation system further comprises:

intake side and exhaust side rocker arms cooperatively connected to the corresponding intake valve and exhaust valve and individually in sliding contact with the lower part of the valve-operating cam at positions on opposite sides of, and an equal distance from, a vertical line passing through the rotational axis of the valve-operating cam coaxially and integrally formed with the driven wheel, a pair of the oil splashing ribs being positioned outside of a pair of vertical lines, in a projection on a vertical plane that is orthogonal to the rotational axis of the valve-operating cam, that pass through the parts of the rocker arms that are in sliding contact with the valve-operating cam.

* * * * *